US005809858A

United States Patent [19]

DeRoo, Sr.

[11] Patent Number: 5,809,858

[45] Date of Patent: Sep. 22, 1998

[54] DEVICE FOR ACHIEVING OPTIMUM LEVELING OF CUTTING DIE AND PLATEN COMPONENTS IN DIE CUTTING MACHINES

[76] Inventor: Paul Wesley DeRoo, Sr., 15707 Horton Rd., Kenosha, Wis. 53142

[21] Appl. No.: 760,035

[22] Filed: Dec. 4, 1996

[51] Int. Cl.[6] ..... B26D 5/08

[52] U.S. Cl. ..... 83/542; 83/547; 83/698.31

[58] Field of Search ..... 83/542, 547, 566, 83/698.31, 698.71

[56] References Cited

U.S. PATENT DOCUMENTS

| | | | |
|---|---|---|---|
| 2,186,594 | 1/1940 | Rosenberg | 83/547 |
| 2,431,566 | 11/1947 | Kopczynski | 83/698.31 |
| 3,269,234 | 8/1966 | Talas | 83/542 |
| 3,373,643 | 3/1968 | Spengler | 83/698.71 |
| 4,256,026 | 3/1981 | Marbach . | |
| 4,955,855 | 9/1990 | Saebeler et al. | 493/404 |
| 5,172,622 | 12/1992 | Sabin | 83/698.71 |

FOREIGN PATENT DOCUMENTS

| | | | |
|---|---|---|---|
| 578143 | 10/1977 | U.S.S.R. | 83/542 |
| 16090 | 7/1909 | United Kingdom | 83/547 |

*Primary Examiner*—Maurina T. Rachuba

*Attorney, Agent, or Firm*—Burns, Doane, Swecker & Mathis, L.L.P.

[57] ABSTRACT

There is disclosed herein a device for achieving and maintaining the optimum positioning of the cutting die and platen components on a die cutting machine used for cutting and scoring paper, plastic, leather, cloth, metal, and other like materials. The device compensates for inherent deviations present in each individual die cutting machine. The invention is comprised of a rigid lightweight metal substructure bonded to an overlayment of a semi-rigid material possessing a unique combination of elastic and compressible properties which allow the cutting knives in a steel rule die to lie in the same horizontal plane as the movable platen.

10 Claims, 2 Drawing Sheets

DEVICE FOR ACHIEVING OPTIMUM LEVELING OF CUTTING DIE AND PLATEN COMPONENTS IN DIE CUTTING MACHINES

BACKGROUND OF THE INVENTION

The invention relates in general to the precision cutting, scoring and embossing of paper, cardboard, plastic, metal or other materials and in particular to a device which compensates for deviations within die cutting machines to achieve near perfect alignment of the cutting rule edge of the die and the cutting surface (platen).

During the manufacturing process, following the placement of a sheet of paperboard or other material, the action of the die cutting machine will produce a "blank" having a predetermined pattern of cut and scored impressions made during contact with the cutting die. With further processing, these blanks will become cartons for various commercial products.

In any die cutting machine there exists some "deviation", wherein the two surfaces which must meet to cut material are not properly aligned or "level". This condition may originate from any one or combination of inherent deficiencies attributed to: the machine and/or its installation; misalignment of the upper stationary die holder, the cutting die and/or the lower movable platen surface; fabrication defects existing in the die itself; or, the unique non-uniform deflection pattern of each new die used in the machine.

A major problem in the cutting and scoring operation is the difficulty in achieving the precise positioning required between the entire cutting edge of the steel rule die and the steel cutting surface. Too much pressure in any one spot can render the die useless; not enough pressure prevents the die from cutting effectively.

The current method of dealing with these problems involves a manual hand operation called "spotting" or "patching". This activity involves the use of small pieces of paper tape ("shims") that are positioned to help improve the cutting operation. The shims must be carefully placed by hand and be of the correct thickness and length. This work is tedious and time consuming and requires a great deal of skill on the part of the cutting press operator.

There have been some attempts to solve this problem but each attempt has introduced its own new problems.

1. U.S. Pat. No. 4,256,026 describes an automatic adjusting rule which is used to improve cutting only for those situations where more pressure is needed at the cutting die contact point in order to achieve effective cutting. However, it cannot adjust for less pressure or to any variation in paper stock thickness that could occur during the "run".

2. U.S. Pat. No. 4,955,855 involves the use of an ultraviolet (UV) ray cured impressible coating. This method introduces two major problems: the apparatus involved in using the UV ray cured impressible coating can only be used for one die and one press thus limiting any reruns to the use of that same press; secondly, it cannot readily adjust to less pressure or to variation in paper stock thickness while in the operation mode.

From the following description and appended claims, it will become readily apparent that this invention is a new and superior device for the industry.

SUMMARY

The invention is a leveling device which compensates for deviations present in die cutting machines to achieve near perfect alignment of the cutting rule edge of the die and the cutting surface (platen) and which requires no external processing. The invention is fabricated from a laminate comprised of a rigid lightweight metal substructure with a thickness of 0.015 inches to 0.125 inches and a bonded overlayment of a semi-rigid material with a thickness of 0.029 inches to 0.032 inches.

The object of the invention is to provide a leveling device which compensates for the minute variations in the contact surfaces of the cutting die, the die holding mechanism and the lower platen of a die cutting machine during the cutting and scoring operations performed by said die cutting machine.

It is also the object of the invention to reduce by 90–100 percent the amount of tedious and tedious handwork involved in getting a die ready to run ("makeready") when using spotting (patching) tape.

Another object is the adaptability of the leveling device for rerun operations and for operations which involve production changes requiring the use of other presses.

A further object is the ability of the leveling device to remain in continuous use on a die cutting machine with each die change.

DESCRIPTION OF THE PREFERRED EMBODIMENT

Figure 1:
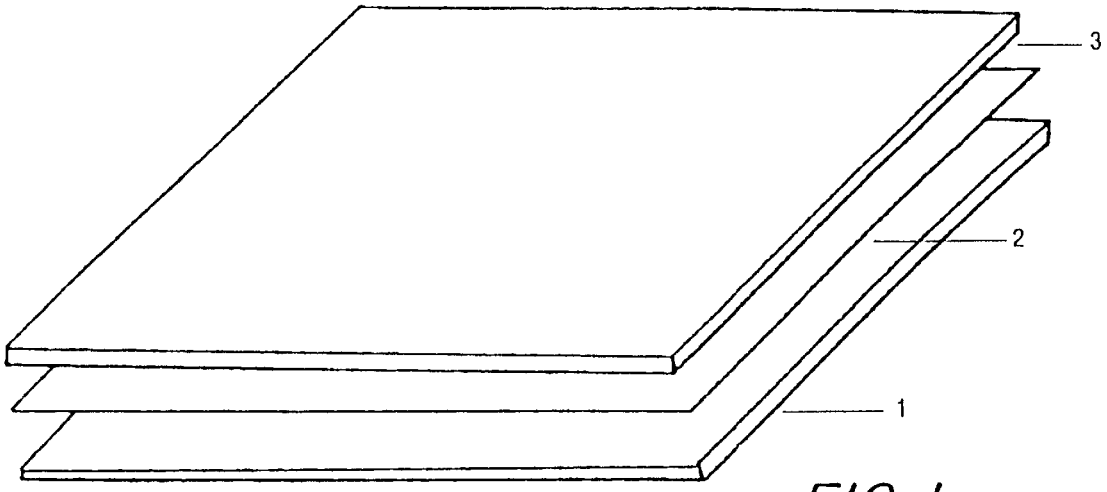
FIG. 1 is an exploded view of the three parts of the leveling device.

Referring now to FIG. 1, there is shown schematically the leveling device comprised of the aluminum base plate 1, the bonding agent 2 and the elastomer sheet 3.

The aluminum base plate 1 has a thickness of 0.015 inches to 0.125 inches. The bonding agent 2 is a polyester film with rubber based adhesive on each side with a total thickness of 0.003 inches. The elastomer sheet 3 is a compressible polymer with a thickness of 0.030 inches plus or minus.

Figure 2:
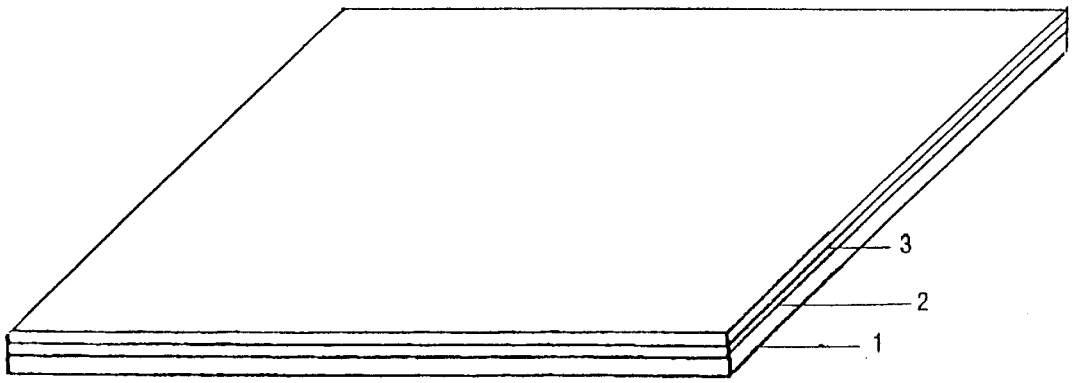
FIG. 2 is an enlarged view of the assembled leveling device.

FIG. 2 illustrates the leveling device assembled. This is accomplished by laminating the three components, as follows: the aluminum base plate 1 is placed on a flat surface; the bonding agent 2 is applied over the surface of the aluminum base plate 1 from a roll of two-sided adhesive polyester film with a release liner on top; the release liner is removed exposing the adhesive top side; the elastomer sheet 3 is then applied to the adhesive. This completes the lamination process. The total thickness of the laminated leveling device is 0.048 inches to 0.158 inches. The variation in thickness relates to the specifications of the individual die cutting machine on which the leveling device is to be used. The variable is accommodated by adjusting the thickness of the aluminum base plate 1.

Figure 3:
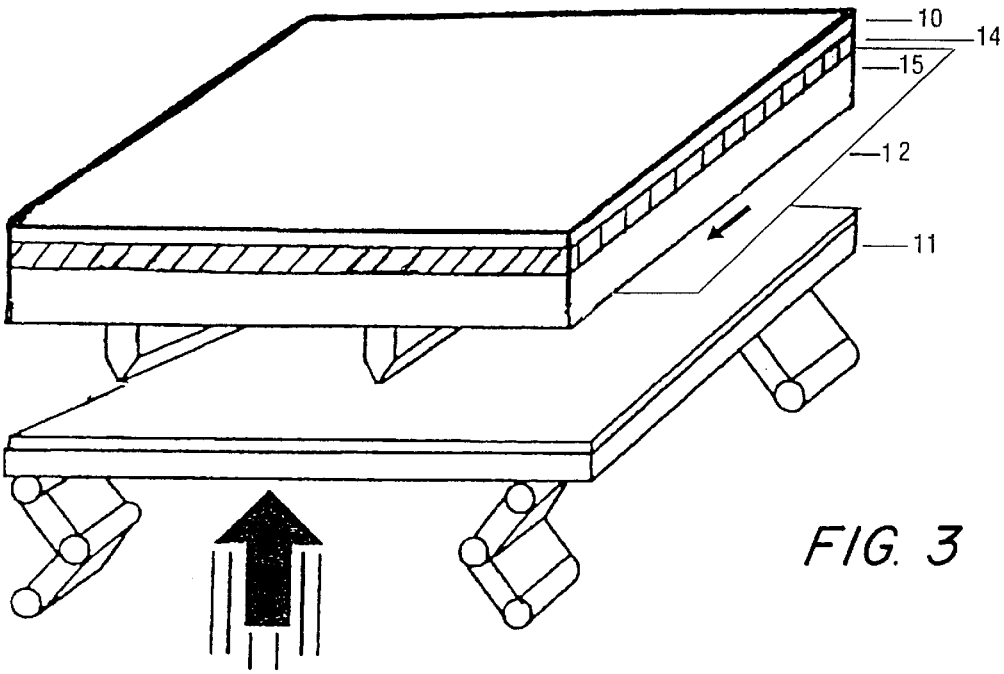
FIG. 3 is a perspective view of the working parts of a sheet stock fed die cutting machine in ready position.

The introduction of the leveling device into the die cutting machine is performed as follows:

FIG. 3 is a schematic drawing of the die holding and cutting area of a sheet fed die cutting machine showing the stationary cutting die holder 10, the cutting die and knife assembly in fixed position within its chase 15 and the cutting plate 11.

In order to effectively cut the material, it is necessary to adjust (makeready) the machine, placing the cutting die 15 in a fixed position for cutting. This is accomplished by seating the back edge of the cutting die 15 against the bottom of the steel chase. The leveling device 14 is placed on the top of the steel chase. The cutting die 15 and the leveling device 14 are locked into position up against the stationary platen 10. The machine controls the movement of the sheet stock material 12 over the surface of the die cutting plate 11 and the timing of the opening and closing of the movable platen 11.

During the cutting operation, the elastic action of the leveling device 14 compensates for the inherent irregularities of the cutting die 15, the stationary die holder 10, the movable platen 11 and other critical components of the machine.

The use of the leveling device 14 produces an effective cutting surface without the extensive aid of paper tape shims. This is accomplished as the cutting surface 11 is brought in contact with the cutting edge of the cutting rule 15 in the makeready operation. As the cutting rule 15 is brought under increased pressure during the cutting operation, it compresses the elastomer sheet (FIGS. 1–3) in the leveling device 14 and the die 15 begins cutting more effectively in reaction to the varying amounts of pressure caused by: high and low spots that may exist on the surface of the stationary platen 10, the die rule 15, or the lower platen 11; non-uniform tolerances produced by extended wear of the lower platen 11 closing mechanism; the flexing of the lower platen 11 due to die misalignment; or the non-uniform composition (rigidity) of the material 12 being cut. The leveling device 14 compresses above those areas of the die 15 where initial cutting takes place in the early stages of the makeready operation. As the cutting action continues, pressure increases gradually on other areas of the die 15 as the elastomer sheet (FIGS. 1–3) continues to compensate for the variation in cutting pressure produced by the aforementioned irregularities that may be present in the operation. It is the unique elastic properties of the elastomer sheet (FIGS. 1–3) as well as its ability to resist compression only at those points where it is needed or where it is compressed to its limit which allows it to maintain the optimum cutting conditions for the duration of the cutting operation.

Following completion of the die stroke, the leveling device 14, because of its elastic properties, returns to its original dimensional form ready to be used for additional operations. When used according to directions, the leveling device 14 can be used repeatedly with minimal set-up time for any new die.

Figure 4:
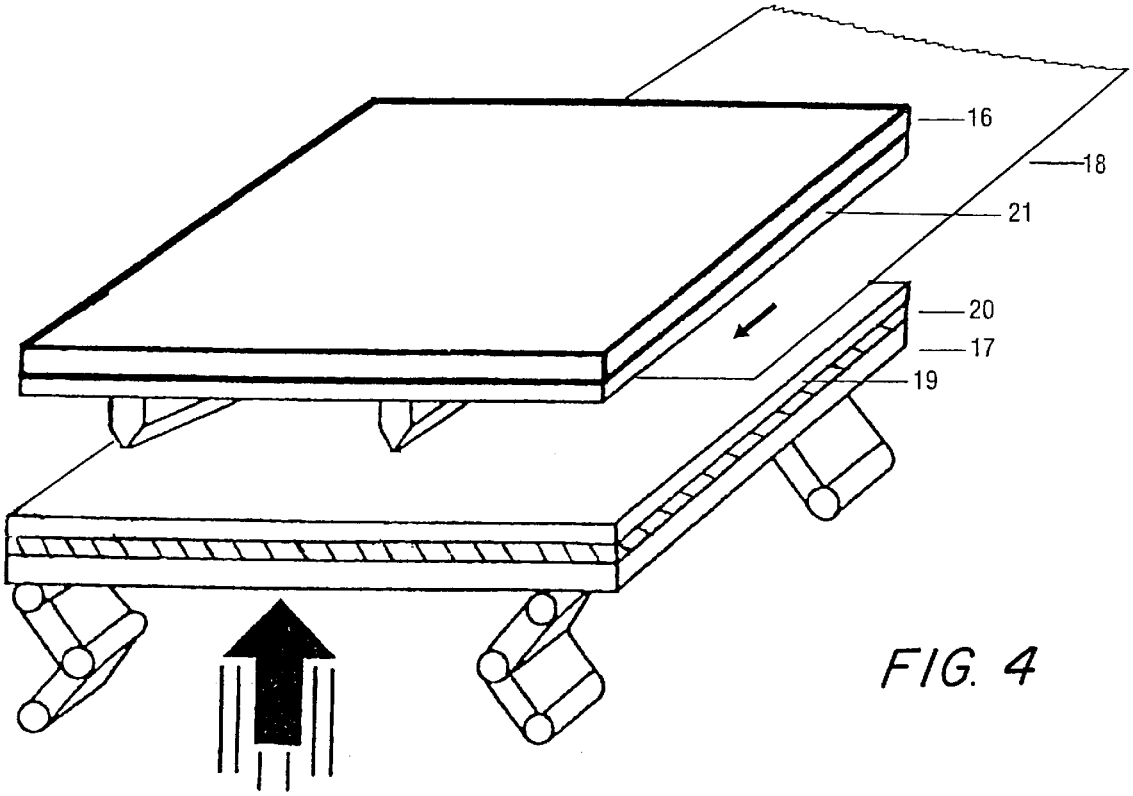
FIG. 4 is a perspective view of the working parts of a roll stock fed die cutting machine in ready position.

Another embodiment of the leveling device is seen in FIG. 4, a schematic drawing of a roll fed die cutting machine showing the stationary cutting die holder 16, the cutting die in fixed position within its chase 21 and the movable platen 17. On a roll fed machine, the leveling device 20 is placed between the movable platen 17 and the cutting plate 19. This machine configuration is now in position to transfer the non-uniform cutting forces exerted on the cutting plate 19 to the leveling device 20 that is supported by and in full contact with the surface of the movable platen 17. The machine controls the movement of the roll stock material 18 over the surface of the cutting plate 19 and the timing of the opening and closing of the movable platen 17.

During the cutting operation, the elastic action of the leveling device 20 compensates for the inherent irregularities of the cutting die 21, the stationary die holder 16, the movable platen 17 and other critical components of the machine.

The leveling device provides the die cutting industry with a means of improving and simplifying the spotting makeready operation. The unique combination of elasticity and compressibility of the elastomer sheet within the leveling device produces the desired result of allowing the cutting knives in a steel rule die to lie in the same horizontal plane as the movable platen. The cutting operation can then take place in the same horizontal plane resulting in precise and efficient cutting of the material. Field testing has shown that the use of the leveling device can reduce spotting makeready time by 90–100 percent when compared to current industry practice. The leveling device improves and simplifies spotting makereadies for rerun operations and can be used repeatedly on die cutting machines regardless of the die being used.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. In a die cutting machine comprising a cutting section and a supporting section; the cutting section including a cutting edge arrangement; the supporting section including a platen holder and a platen mounted on the platen holder, the platen facing the cutting die and adapted to support an item to be cut; the cutting section and supporting section being relatively movable to cause the cutting edge arrangement and platen to come into contact with one another during a cutting operation; the improvement comprising:

a leveling device comprising an aluminum base plate, an elastomeric sheet formed of an elastomeric polymer, and a bonding agent disposed between the base plate and the sheet for bonding the base plate to the sheet, a total thickness of the leveling device being in the range of 0.048 to 0.158 inches;

the leveling device positioned between the die holder and the cutting die whereby portions of the elastomeric sheet are elastically compressed in response to contact between the cutting edge arrangement and the platen for enabling the cutting edge arrangement to assume a parallel relationship with the platen.

2. In the die cutting machine according to claim 1, wherein the elastomeric sheet has a thickness of substantially 0.030 inches.

3. In the die cutting machine according to claim 1, wherein the bonding agent comprises a compressible polyester film with rubber-based adhesive on each side thereof.

4. In the die cutting machine according to claim 3, wherein the total thickness of the bonding agent is substantially 0.003 inches.

5. In the die cutting machine according to claim 1, wherein the supporting section is movable up and down and the cutting section is stationary.

6. In a die cutting machine comprising a cutting section and a supporting section; the cutting section including a cutting edge arrangement; the supporting section including a platen holder and a platen mounted on the platen holder, the platen facing the cutting die and adapted to support an item to be cut; the cutting section and supporting section being relatively movable to cause the cutting edge arrangement and platen to come into contact with one another during a cutting operation; the improvement comprising:

a leveling device comprising an aluminum base plate, an elastomeric sheet formed of an elastomeric polymer, and a bonding agent disposed between the base plate and the sheet for bonding the base plate to the sheet, a total thickness of the leveling device being in the range of 0.048 to 0.158 inches;

the leveling device positioned between the platen holder and the platen whereby portions of the elastomeric sheet are elastically compressed in response to contact between the cutting edge arrangement and the platen for enabling the cutting edge arrangement to assume a parallel relationship with the platen.

7. In the die cutting machine according to claim 6, wherein the elastomeric sheet has a thickness of substantially 0.030 inches.

8. In the die cutting machine according to claim 6, wherein the bonding agent comprises a compressible polyester film with rubber-based adhesive on each side thereof.

9. In the die cutting machine according to claim 8, wherein the total thickness of the bonding agent is substantially 0.003 inches.

10. In the die cutting machine according to claim 6, wherein the supporting section is movable up and down and the cutting section is stationary.

* * * * *